United States Patent [19]

Wood et al.

[11] Patent Number: 4,640,030

[45] Date of Patent: Feb. 3, 1987

[54] COMBINATION ENVELOPE AND DISPLAY DEVICE

[76] Inventors: Marcus B. Wood; Richard K. Owen, both of 174 Woodstock Ct., Claremont, Calif. 91711

[21] Appl. No.: 618,565

[22] Filed: Jun. 8, 1984

[51] Int. Cl.[4] ..... G09F 1/10

[52] U.S. Cl. ..... 40/158 R; 40/152.1; 229/71

[58] Field of Search ..... 40/124.1, 158 B, 158 R, 40/152.1; 229/71; 40/359, 360

[56] References Cited

U.S. PATENT DOCUMENTS

| | | | |
|---|---|---|---|
| 2,219,492 | 10/1940 | Prichap | 40/152.1 |
| 2,453,902 | 11/1948 | Graham | 40/152.1 |
| 2,867,927 | 1/1959 | Schwartz | 40/158 R |
| 3,304,641 | 2/1967 | Gonczy | 40/158 R |
| 4,014,120 | 3/1977 | Merz | 40/152.1 |
| 4,048,740 | 9/1977 | Zizelberger | 40/158 R |

FOREIGN PATENT DOCUMENTS

| | | | |
|---|---|---|---|
| 1456907 | 10/1966 | France | 40/158 R |

*Primary Examiner*—Gene Mancene
*Assistant Examiner*—Wenceslao J. Contreras
*Attorney, Agent, or Firm*—Edgar W. Averill, Jr.

[57] ABSTRACT

A combination envelope and display device includes front and side flaps combined to form an envelope enclosure together with a back flap which may be folded upon the envelope enclosure and secured thereto by a delayed-tack adhesive or folded to provide a support for display use. The front panel defines a window with surrounding frame and an overlying removable address panel. The address panel may be inscribed with appropriate postage and address and removed by the recipient to expose the envelope contents for display.

8 Claims, 9 Drawing Figures

From
To:

COMBINATION ENVELOPE AND DISPLAY DEVICE

BACKGROUND OF THE INVENTION

This invention relates generally to mailing envelopes, and more particularly to those used for transmitting a picture or other to-be-displayed text materials wherein the envelope also serves as a display frame for the material by the addressee.

Often, persons transmitting personal messages or mail include a picture or similar material for use by the addressee. For the most part, such pictures are examined initially by the addressee and are all too often casually stored in drawers and closets or even lost by the recipient. Mailing a common frame is both expensive an often results in breakage. Occasionally, the pictures are framed by the recipient and displayed. However, because frames tend to be expensive and because some time and effort are involved in selecting and purchasing a frame for such received pictures, there is little assurance to the sender that the picture once received will eventually find its way to a place of display by the recipient.

In addition to personal and private communications of pictures and similar materials, many uses such as advertising, commercial messages and other business uses as well as religious and political group communications involve pictorial material which is intended to be suitable for framing. Quite often such included material is intended to induce the recipient to more carefully examine the contents of the envelope than normally occurs by the recipients of such material.

The foregoing needs have led practitioners in the art to produce many devices which serve as mailing envelopes and display devices for pictures mailed therein. One such combination device is set forth in U.S. Pat. No. 4,343,105 which shows a mailing envelope having front, back and side surfaces folded and configured to produce an envelope enclosure and a slot in the back portion thereof through which a tongue-like member extends in a downward direction to provide a support for the envelope when used as a display frame.

While this device and many of the other presently available combination envelope and display devices exist, many add weight, are expensive or difficult to use and most, if not all, are not conveniently reusable. There remains, therefore, a need in the art for a lightweight reusable combination envelope and display device which may be filled, addressed and sealed by the sender as easily and conveniently as a conventional envelope. The present invention fills the gap between a standard picture frame and the above-described mailing envelopes.

SUMMARY OF THE INVENTION

Accordingly, it is a general object of the present invention to provide an improved combination envelope and display device. It is a more particular object of the present invention to provide an improved combination envelope and display device which may be used as easily. conveniently and inexpensively as a conventional envelope. It is a still more particular object of the present invention to provide such a combination envelope and display device which is reusable.

Accordingly, there is provided by the present invention an envelope including a front surface, a bottom flap and a pair of side flaps folded to define an envelope enclosure which is closed on three sides and open on the fourth and in which the front surface defines a window and a removable address panel overlying the window. The envelope further includes a back surface which is hinged to the open side of the envelope enclosure and serves as the sealing flap tor the enclosure during mailing and as a support for the envelope when used as a display device.

BRIEF DESCRIPTION OF THE DRAWINGS

The features of the present invention which are believed to be novel are set forth with particularity in the appended claims. The invention, together with further objects and advantages thereof, may thus be understood by reference to the following descriptions taken in conjunction with the accompanying drawings, in the several figures of which like reference numerals identify like elements, and in which:

DESCRIPTION OF THE PREFERRED EMBODIMENTS

Figures 1, 2, 3, 4, 5:
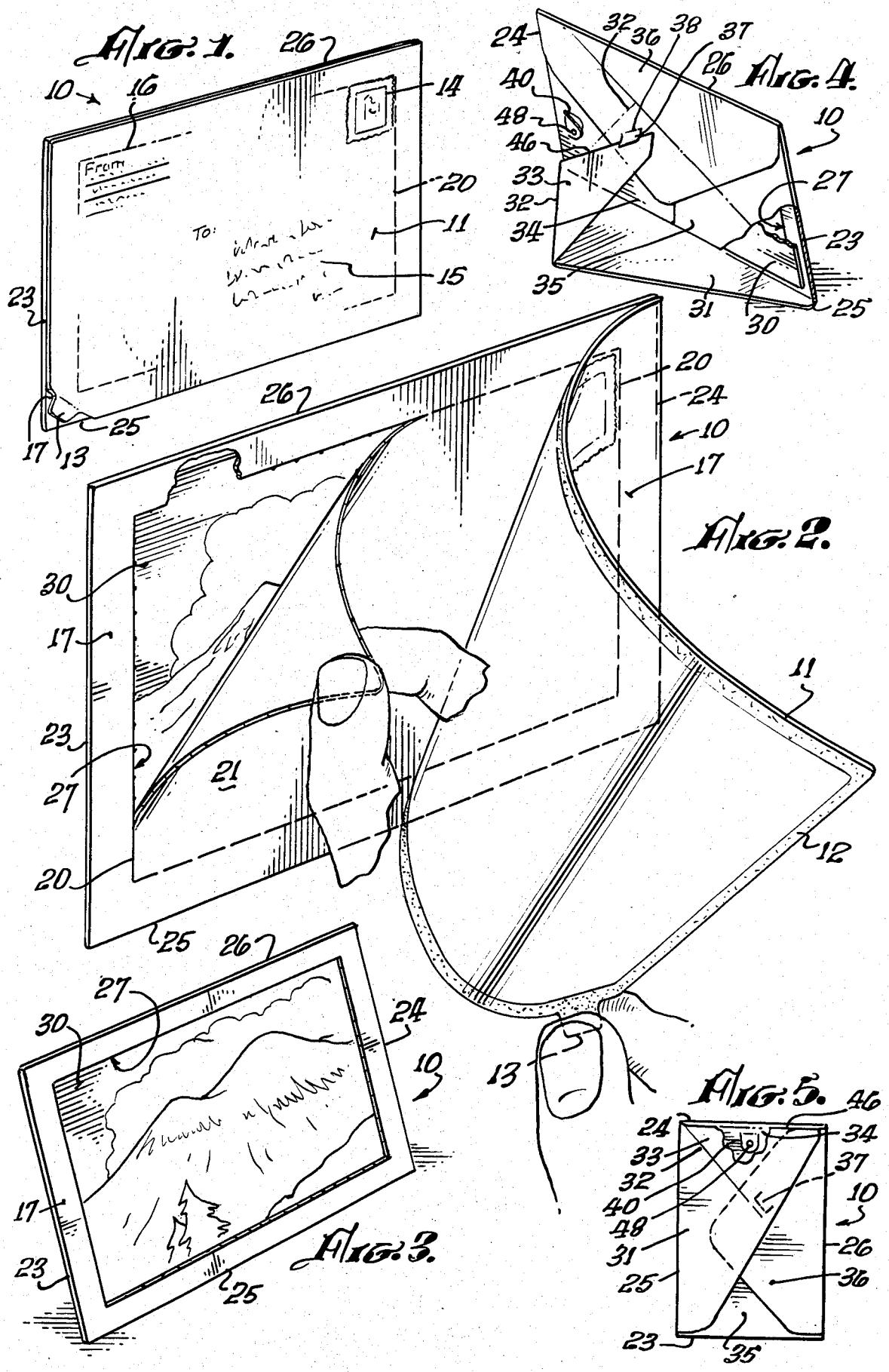
FIG. 1 is a pictorial view of a combination mailing envelope and display device constructed in accordance with the present invention.
FIG. 2 is a pictorial view of the present invention combination mailing envelope and display device showing partial removal of the address panel and front face tearout.
FIG. 3 is a pictorial view of the present invention combination mailing envelope and display device having the address panel and front face tearout completely removed and displaying a picture.
FIG. 4 is a partially sectioned rear view of the present invention combination mailing envelope and display device shown in FIG. 3.
FIG. 5 is a partially sectioned rear view of the present invention combination mailing envelope and display device in its sealed configuration.

FIG. 1 shows a pictorial front view of the present invention combination mailing envelope and display device hereinafter referred to generally as "envelope" and identified generally by the reference numeral 10. Envelope 10 includes a front face generally identified by the reference numeral 17 which supports an address panel 11 having a rectangular configuration corresponding to that of envelope 10 and bearing a postage stamp 14, a return address 16 and an address designation 15. In accordance with conventional postal practices, postage stamp 14, return address 16 and addressee designation 15 are applied by the sender. Address panel 11 further defines a tab 13 extending outwardly from the lower left-hand corner of address panel 11. The purpose and function of tab 13 are set forth below in greater detail. However, suffice it to say here that tab 13 is not secured to front face 17 of envelope 10 but is free on three sides permitting a finger grip to be obtained upon it. The use of a tab such as tab 13 is optional and the address panel 11 may simply be peeled from the envelope portion without the use of any tab. Front face 17 further includes a serration 20 which may be of an shape selected by choice. However, in the present embodiment, serration 20 conforms generally to the rectangular format of front face 17 of envelope 10 and is located within the portion of front face 17 covered by address panel 11. As will be apparent from examination of FIG. 1, envelope 10 is configured to provide a secure mailing enclosure conveniently addressable, postable and return addressable by the sender in accordance with the same practices used with conventional envelopes.

FIG. 2 shows a pictorial depiction of the removal of address panel 11 from front face 17 in accordance with an important aspect of the present invention. In the anticipated use of envelope 10, this practice will, of course, be carried out by the receiver once envelope 10 has been appropriately addressed, posted and transmitted through conventional mail channels. As mentioned, envelope 10 is of a generally rectangular configuration and therefore defines a left edge 23, a right edge 24, a bottom edge 25 and a top edge 26. In accordance with the foregoing, serration 20 generally parallels the respective left, right, bottom and top edges of envelope 10 to define a closed rectangular serration line which is constructed to provide easy tearing along the serration. Accordingly serration 20 could include a plurality of cuts in front face 17, separated by small portions of uncut paper. Address panel 11 further includes an adhesive layer which may completely cover its inner face. Alternatively, an adhesive border 12, extending continuously about its entire perimeter and extending inwardly from the edge of address panel 11 may be used as shown in FIG. 2. Adhesive border 12 is formed of an adhesive having the property commonly described in the art as a delayed-tack. Such adhesives are so named because of the property by which they remain tacky or sticky when bonding pieces of material together. This permits bonded materials to be repeatedly bonded and separated without damage to the bonded surface. In accordance with an important aspect of the present invention, address panel 11 is secured to front face 17 of envelope 10 by the adhesion of the delayed-tack material of adhesive border 12 upon a portion of front face 7 surrounding serration 20. As is shown in FIG. 2, address panel 11 may be removed from front face 17 of envelope 10 by grasping tab 13 and pulling tab 13 and thereby address panel 11 away from front face 17 in a peeling motion. The portion of front face 17 within serration 20 defines a front face tearout 21 which, as shown in FIG. 2, may be separated from front face 17 by tearing serration 20 in a second peeling motion similar to that used to remove address panel 11. Once front face tearout 21 has been removed from front face 17, there is defined in front face 17 a window 27 having a frame 22 surrounding it. Preferably, address panel 11 completely covers front face 17 in order to help prevent soiling of the front face during mailing. Frame 22 is bounded on its interior by serration line 20 and on its exterior by left edge 23, right edge 24 and bottom and top edges 25 and 26, respectively. A picture 30 preferably having a size greater than the dimensions of window 27 but less than the outer dimensions of front face 17 is enclosed within envelope 10 beneath front face tearout 21 and is retained within envelope 10 by the overlap of frame 22. with address panel 11 and front face tearout 21 removed, the front portion of envelope 10 takes on the configuration shown in FIG. 3.

FIG. 3 shows envelope 10 with address panel 11 and front face tearout 21 removed exposing picture 30. As mentioned, picture 30 is retained within envelope 10 by the overlaping portion of frame 22 which forms a border about the picture. In the position shown in FIG. 3, envelope 10 is in the horizontal position in which it rests upon bottom edge 25. In contrast, FIG. 4 shows the rear view of envelope 10 resting in the horizontal position. The rear portion of envelope 10 will be described below in greater detail in conjunction with FIGS. 5 and 6. However, suffice it to say here that envelope 10 includes a pair of flaps 34 and 35 extending inwardly from right edge 24 and left edge 23, respectively. A flap 36 extends inwardly from top edge 26 and folds over flaps 34 and 35. As will also be discussed below in greater detail, flaps 34, 35 and 36 are adhesively bound together and form an envelope enclosure having an opening along bottom edge 25. A flap 31 extends back from bottom edge 25 and forms the base upon which envelope 10 may be rested in the inclined position shown in FIGS. 3 and 4. A flap 33 joined to flap 31 along a fold line 32 extends upwardly and inwardly from flap 31 and defines an edge 46 which rests upon flaps 34 and 36. In accordance with an important aspect of the present invention, flap 36 further defines a generally U-shaped cutout 37 which forms a tab extending away from flap 36 and is joined thereto along a seam 38. Flap 33 is secured to flap 36 by placing edge 46 thereof beneath cutout 37 until it rests against seam 38.

Examination of FIGS. 3 and 4 together shows that envelope 10 may be displayed in a horizontal orientation in which it is supported by the rigidity of flap 33 and rests upon the base formed by flap 31. In this position, picture 30 (shown in the partially sectioned view of FIG. 4) rests within the enclosure of envelope 10 formed by flaps 34, 35 and 36 and is maintained behind window 27 by frame 22. In accordance with another aspect of the present invention structure, flap 34 further defines a cutout 40 which, in turn, defines an aperture 48. The function of cutout 40 and aperture 48 will be described below.

FIG. 5 shows envelope 10 in the completely sealed configuration of FIG. 1, viewed from behind, in which flaps 34, 35 and 36 have been inwardly folded and mutually bonded to form an envelope enclosure and in which the combined structure of flaps 31 and 33 are secured overlying flaps 34, 35 and 36. As is apparent in FIG. 5, the folding over of the combination flaps 31 and 33 completes the sealing of the enclosure of envelope 10 and places envelope 10 in the appropriate configuration for mailing.

Figure 6:
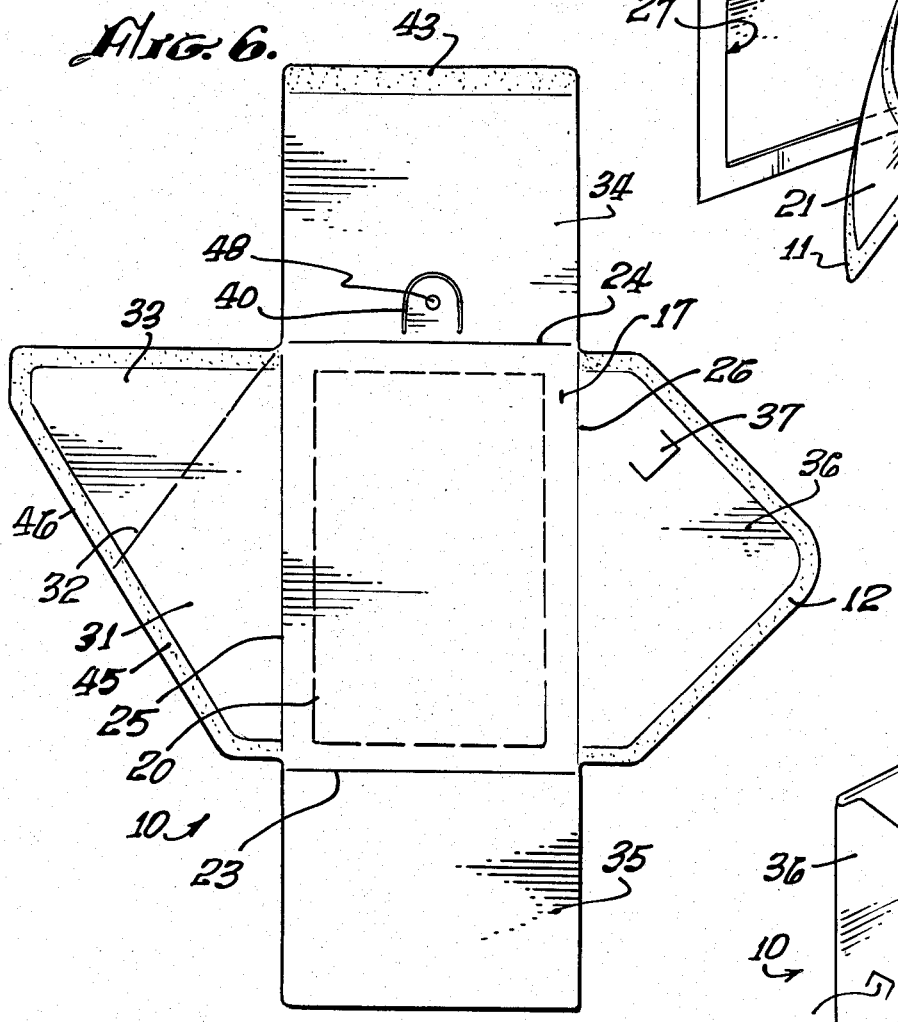
FIG. 6 shows the present invention combination mailing envelope and display device prior to folding and assembly.

FIG. 6 shows envelope 10 in a completely unfolded configuration in which front face 17 defines a generally planar rectangular surface having an inset rectangular serration 20 and is bounded by a left edge 23, a right edge 24, a bottom edge 25 and a top edge 26. A flap 36 joined to front face 17 along top edge 26 defines a cutout 37, the function of which is described and set forth above, and an adhesive area 42. Adhesive area 42 extends inwardly from the outer edges of flap 36 for an appropriate distance to provide sufficient adhesive contact for the sealing of the envelope enclosure described below. Flap 34 defines a generally rectangular configuration joined to front surface 17 along right edge 24 and includes an adhesive area 43 extending along its outer edge and a cutout 40 and an aperture 48. Flap 35 is of generally rectangular configuration and is joined to front face 17 along left edge 23. Flap 31 is of generally triangular configuration and is joined to front face 17 along bottom edge 25. Flap 31 defines a fold line 32 and an edge 46. Flap 32 is joined to flap 31 along fold line 32 and defines a continuation of edge 46. An adhesive area 45 extends along the outer perimeters of flaps 31 and 33. In accordance with an important aspect of the present invention, adhesive area 45 comprises a delayed-tack adhesive of the type described above wherein flaps 31 and 33 may be repeatedly joined to and removed from the surfaces of flaps 34, 35 and 36 without damage to either adhesive are 45 or the flap surface.

Figure 8:
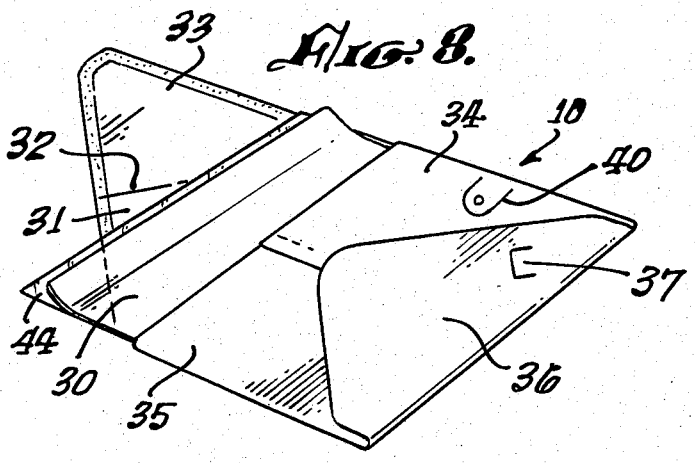
FIG. 8 is a pictorial view of the present invention combination mailing envelope and display device prior to sealing.

Assembly of envelope 10 is carried forward in the following manner. With envelope 10 lying flat as shown in FIG. 6, flap 35 is folded inward along left edge 23 until it overlies a portion of the interior surface of front face 17. Thereafter, flap 34 is folded inward along right edge 24 until adhesive area 43 overlies a portion of flap 35 using adhesive area 43 flap 34 is then bonded to flap 35. Next, flap 36 is folded inwardly along top edge 26 until it overlaps the combination of flaps 34 and 35, after which, adhesive area 42 is used to bond flap 36 to the combination of flaps 34 and 35. White adhesive areas 42 and 43 have been shown in the drawings, the assembly step could use heat sealing rather than an adhesive area depending upon the material of construction of the envelope. At this point, envelope 10 has assumed the configuration shown in FIG. 8 and with temporary reference to FIG. 8, picture 30 may now be placed within the enclosure formed by flaps 34, 35 and 36 of envelope 10 in preparation for transmission through the mail. In addition, FIG. 8 also shows a further embodiment of the present invention which includes an optional feature in which a generally rectangular transparent plastic layer 44 is inserted along with picture 30 and is interposed between picture 30 and front surface 17. The purpose of transparent layer 44 is to provide a protective layer for picture 30 once front face tearout 21 has been removed to display picture 30. Transparent layer 44 may be included or omitted as a matter of choice without departure from the spirit and scope of the present invention and except for the step of inserting transparent layer 44 the use of envelope 10 remains the same with or without it. With the insertion of picture 30 (and transparent layer 44 if included) within the enclosure of envelope 10 shown in FIG. 8, sealing of envelope 10 is completed by folding the combination of flaps 31 and 33. without making any fold along fold line 32, inwardly about bottom edge 25 until adhesive area 45 contacts and seals itself to the combination of flaps 34, 35 and 36. With such sealing complete, envelope 10 is configured in accordance with that configuration shown in FIGS. 5 and 1.

Figure 9:
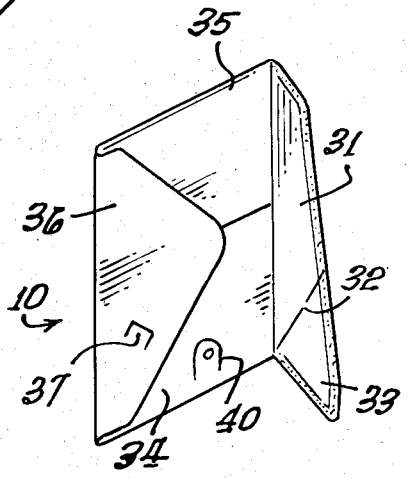
FIG. 9 is a pictorial rear view rear of the present invention combination mailing envelope and displaying device resting in the vertical display position.

FIG. 9 shows envelope 10 displayed in its vertical orientation in which the preceding described removal of address panel 11 and front face tearout 21 has been carried forward together with the unsealing of flaps 33 and 31. In the configuration shown in FIG. 9, however, unlike that of the horizontal display shown in FIG. 4 flaps 31 and 33 remain in line, that is, no fold has been made along fold line 32. The backward extension of the combination of flaps 31 and 33 serves as a support for envelope 10 in a vertical position. It will, of course, be obvious to those skilled in the art that in accordance with an important aspect of the present invention. envelope 10 may by appropriate configuration of flaps 31 and 33 be repeatedly and alternatively supported in either the vertical orientation of display shown in FIG. 9 or the horizontal orientation shown in FIG. 4.

Figure 7:
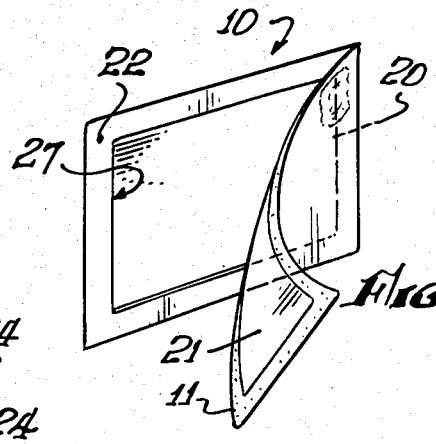
FIG. 7 is a pictorial view of an alternate embodiment of the present invention combination mailing envelope and display device.

FIG. 7 sets forth an alternate embodiment of the present invention envelope and display combination in which address panel 11 and front face tearout 21 are bonded together by the delayed-tack adhesive which covers the entire inner surface of address panel 11). As a result, the single peel off operation depicted above in connection with FIG. 2 is carried forward and simultaneously removes address panel 11 and tears front face tearout 21 loose along serration 20 in a single operation. The use of a single operation tearout depicted in FIG. 7 or the separate tearout of front face tearout 21 depicted in the embodiment of FIG. 2 represents a matter of user's choice. However, each is clearly seen to fall within the spirit and scope of the present invention.

In addition, as will be apparent to those skilled in the art, front face tearout 21 may as an alternative to serration 20 be removed prior to the application of address panel 11. In other words, envelope 10 would in this embodiment be identical to the configuration shown in FIG. 6 with the exception that window 27 would already be open due to the removal of the area referred to as tearout 21 prior to the application of address panel 11.

Numerous other variations of the present invention may be envisioned by those skilled in the art without departing from the spirit and scope of the present invention. For example, the entire figuration as shown in FIG. 6 may be used with all adhesive areas being the delayed tack configuration in which case the entire envelope may be repeatedly used, completely opened, and reused. In addition, it is well within the scope of the present invention to use envelope 10 repeatedly by providing multiple address panels 11. In other words, the present invention combination envelope and display device may be repeatedly mailed by simply replacing address panel 11 with a second address panel bearing a second address for further return transmission of envelope 10.

What has been shown is a novel combination mailing envelope and display device for use in the transmission and display of a picture or similar material which can be sealed, addressed and posted in accordance with conventional techniques used in conventional mailing envelopes and which provides a removable front address panel. The structure shown is comparable in cost to conventional envelopes and requires no additional operations by the sender beyond those employed in the use of conventional mailing envelopes.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A combination envelope and display device comprising:

a front surface, a bottom flap and a pair of side flaps folded to define and envelope enclosure having an open side, said front surface defining a window portion;

a removable address panel overlying said window portion and including adhesive means for removably attaching said removable address panel to said front surface; and a support flap, hingeably attached to said front surface along said open side of said envelope enclosure;

said support flap alternatively configurable to either a first position in which said envelope enclosure is sealed or a second position to provide a support for display use of said combination envelope and display device and when said support flap includes a deposit of delayed tack adhesive located upon said support flap, such that said support flap is removably attached to said bottom and side flaps when said support flap is configured in said first position and wherein said bottom flap defines a first generally U-shaped tab cutout and wherein said support flap may be configured in a third position in which a portion thereof is received beneath said first tab cutout.

2. A combination envelope and display device as set forth in claim 1 wherein said front surface includes a frame portion surrounding said window portion.

3. A combination envelope and display device as set forth in claim 2 wherein said adhesive means includes a delayed-tack adhesive deposited upon the portion of said removable address panel contacting said frame portion.

4. A combination envelope and display device as set forth in claim 1 wherein one of said pair of side flaps defines a second generally U-shaped tab cutout and an aperture therein whereby said envelope and display device may be hung from said second tab cutout.

5. A combination envelope and display device as set forth in claim 1 wherein said removable address panel includes a tab extension, free of said adhesive material for use in removing said removable address panel from said front surface.

6. A combination envelope and display device as set forth in claim 1 wherein said window portion is adhered to the removable front face tear out and said removable address panel is attached to said front face tear out such that removal of said removable address panel also removes said front face tear out.

7. A combination envelope and display device as set forth in claim 1 wherein a picture is placed within said envelope enclosure and wherein said envelope and display device further includes a sheet of transparent material interposed between said front surface and said picture.

8. A combination envelope and display device comprising:

a front face, formed of a generally rectangular planar sheet of paper, defining first, second, third and fourth edges and a generally rectangular window tearout portion;

a pair of side flaps formed of paper and attached to said second and fourth edges respectively;

a bottom flap formed of a generally triangular sheet of paper defining a base attached to said third edge;

a support flap formed of a right triangular sheet of paper defining first and second adjacent sides and a hypotenuse and attached to said first side along said first adjacent sides; and a removable address panel formed of a generally rectangular sheet of paper having at least the border of its inner surface coated with a delayed-tack adhesive, said removable address panel being larger than said window tearout portion;

said pair of side flaps and said bottom flap being inwardly folded along said second, fourth and third edges respectively to form a four-sided envelope enclosure open along said first edge and said support flap being positionable in a first position in which it overlys said side and bottom flaps and closes said envelope enclosure and a second position in which it extends away from said enclosure and forms a support permitting said combination envelope and display device to rest upon said second edge.

* * * * *